US006454226B2

(12) United States Patent
Epping et al.

(10) Patent No.: US 6,454,226 B2
(45) Date of Patent: Sep. 24, 2002

(54) HOLDING DEVICE FOR THE ATTACHMENT OF A MICROPHONE TO AN OBJECT

(75) Inventors: Heinz Epping, Neustadt; Christian Grone, Garbsen; Gerd Söhnholz, Essel, all of (DE)

(73) Assignee: Sennheiser Electronic GmbH & Co. KG (DE)

( * ) Notice: Subject to any disclaimer, the term of this patent is extended or adjusted under 35 U.S.C. 154(b) by 0 days.

(21) Appl. No.: 09/798,225

(22) Filed: Mar. 2, 2001

Related U.S. Application Data

(62) Division of application No. 09/239,448, filed on Jan. 28, 1999, now abandoned.

(30) Foreign Application Priority Data

Jan. 28, 1998 (DE) ..... 198 03 181

(51) Int. Cl.[7] ..... F16M 13/00
(52) U.S. Cl. ..... 248/160; 381/363

(58) Field of Search ..... 248/160, 204; 381/363

(56) References Cited

U.S. PATENT DOCUMENTS

| | | | | |
|---|---|---|---|---|
| 3,584,822 A | * | 6/1971 | Oram | 248/160 |
| 4,853,965 A | * | 8/1989 | Blonski | 248/160 |
| 4,953,821 A | * | 9/1990 | Reuter et al. | 248/281.11 |
| 4,955,578 A | * | 9/1990 | Fidi | 248/559 |
| 5,662,300 A | * | 9/1997 | Michelson | 248/279.1 |
| 5,901,721 A | * | 5/1999 | Sadeghvaziri | 248/160 |
| 5,937,537 A | * | 8/1999 | Miller | 248/160 |

* cited by examiner

*Primary Examiner*—Ramon O. Ramirez
(74) *Attorney, Agent, or Firm*—TraskBritt, PC

(57) ABSTRACT

A holding device for enabling essentially flexible attachment of a microphone to an object, the holding device comprising an attachment at a first end and adjoining element at the second end to which a microphone is positioned, at least part of the holding device being constructed of a dimensionally stable material with high acoustic dissipation qualities.

8 Claims, 1 Drawing Sheet

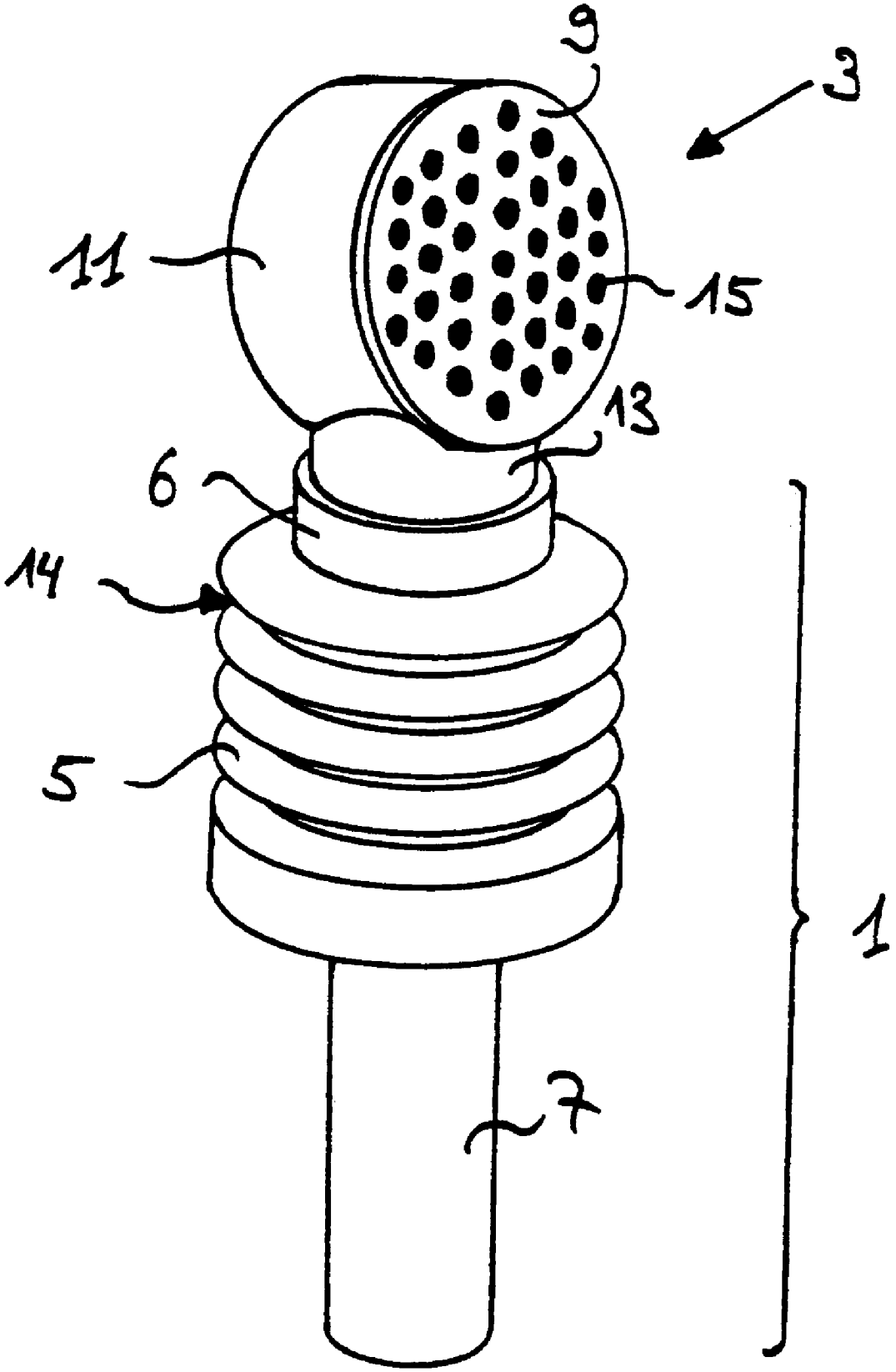
9
3
11
15
13
6
14
5
1
7

HOLDING DEVICE FOR THE ATTACHMENT OF A MICROPHONE TO AN OBJECT

CROSS-REFERENCE TO RELATED APPLICATION

This application is a divisional of application Ser. No. 09/239,448, filed Jan. 28, 1999, now abandoned.

BACKGROUND OF THE INVENTION

1. Field of the Invention

The invention regards a holding device designed for the essentially flexible attachment of a microphone to an object.

2. State of the Art

There are already various holding devices for the attachment of a microphone to an object, such as a musical instrument or a tripod, on the market.

One of those designs features a rigid connection between the micro-phone and a musical instrument or a tripod. However, this rigid connection transmits solid-borne sound, for example, from the musical instrument connected with the holding device, or impact sound to the microphone, causing an audible impairment of the recorded signal.

Another design reduces the signal-impairment caused by the transmission of impact sound through a spring-mounted case for the microphone. The suspension is in fact reducing the transmission of solid-borne sound and is actually improving the signal quality. However, the spring between microphone and holding-case requires a rather large holding apparatus.

SUMMARY OF THE INVENTION

Our invention is designed to provide a smaller, lighter holding device for the attachment of a small microphone to an object, which will sufficiently prevent the transmission of impact sound to the microphone.

The design features a holding device consisting of a holder and a joining element with a microphone attached to its end piece; it is made of dimensionally stable material with high acoustic dissipation qualities.

One of the benefits of our invention is the fact that both microphone and holding device may be designed rather small, resulting in an extensive neutralization of impact sound. The purpose of a miniature-microphone or a microphone-capsule, namely their small size and compact construction, are fully appreciated by the invented holding device, rather than countered through a voluminous and awkward holding arrangement. Furthermore, the simple design of the invented holding device allows for easy use and economical production.

The invented design can be utilized to hold microphones of varying sizes and qualities. It is especially useful for the holding of a miniature microphone or a microphone capsule requiring a very small construction. In the following, we will use the term "microphone", which is not to be interpreted as a reservation.

A preferred design of the holding device features a case surrounding, at least in part, the microphone connected with the holder, and a joining element located between the case and the holding gadgets. The case is essentially directly attached to the microphone and has primarily a protective function. Since the joining element between case and attachment gadgets is designed of flexible material, a suspension between microphone and case is not required, resulting in the complimentary smaller dimensions of the device.

It is especially useful that the joining element is permanently connected with the attachment gadgets and the microphones, respectively the case. This results in an easy to handle microphone with attachable gadgets that can simply be fixed to a musical instrument or to a speaker's or singer's clothing. The connections between microphone, joining element and attachment gadgets may be designed with positive or non-positive fit. A modification of the design features glued attachments, an especially space-saving way of mechanic coupling.

In a preferred style of the design, the attachment gadgets consist of a lug allowing the microphone to be adjusted in relation to the object, such as a musical instrument, to facilitate an optimal quality of the recorded sound. Due to the flexible alignment of the microphone's position, the holding device can be easily adapted to different musical instruments or other objects. Another modification of the invention features a swan-necked lug, a design that is both easily adjustable and highly stable.

The attachment gadgets include an attachment device allowing the detachable fastening of the microphone to different objects. In this case, various clamps can be used as fastening devices, which grip and clamp a portion of the object.

Another useful modification of the designed holding device features expansion bellows as joining element. If the bag is fashioned from suitable synthetic material, it provides sufficient lateral stability to carry the weight of a microphone proportionally fitting to the bellows. In addition, the expansion bellows facilitate a sufficiently low frequency of resonance combined with an extensive dissipation capacity.

According to a preferred modification of the invention, the joining element and the lug both feature a bushing nipple for at least one signal-line and/or supply-line, making an internal direction of lines to an outlet or connector possible. In addition, this design provides a mechanical protection for the often extremely thin lines.

Advantageous modifications of the design are listed as sub-claim features.

In the following, the invention is explained in reference to the enclosed drawing, showing a perspective view of the designed holding device.

BRIEF DESCRIPTION OF THE DRAWING

In the drawing, which illustrates what is currently considered to be the best mode for carrying out the invention:

FIG. 1 is a perspective view of the holding device of the invention.

DETAILED DESCRIPTION OF THE INVENTION

FIG. 1 shows a holding device 1 designed to attach a microphone 3 to an object (not shown), with the microphone flexibly attached to holding device 1.

Holding device 1 features an attachment apparatus, connecting the holding device 1 to an object, such as a musical instrument or similar. In the shown design, the attachment apparatus is a lug 7 that can also be designed in swan-necked shape. The free end of the lug 7 (not shown) features another attachment apparatus, such as a clamp (not shown).

Between lug 7 and microphone 3, we find a joining element causing any impact sound to be neutralized. In the design shown, the joining element consists of an expansion bellows 5, made of dimensionally stable synthetic material with high acoustic dissipation qualities. The expansion bellows has a tubular shape with circular diameter and features several radial wrap-around contractions 14. To the expansion bellows 5 portion facing the microphone 3, a short tubular section 6 serving as connection to the microphone 3 is attached.

The microphone 3 has a cylindrical shape featuring two circular, equally sized front ends 9 the diameter of which fits approximately the outer diameter of the expansion bellows 5, and a wrap-around outer wall. Microphone 3 features on one side of the wrap-around side wall 11 a cylindrical attachment 13 stretching outward. The cylindrical attachment 13 is partly enclosed by the tubular section 6 of the expansion bellows 5, so that the cylindrical attachment 13 is essentially positioned in extension of lug 7 and expansion bellows 5. At least one of the front sides 9 of microphone 3 contains circular perforations 15, serving as openings for the acoustic pick-up.

Signal lines and/or supply lines (not shown) are leading through the cylindrical attachment 13 of microphone 3, the tubular section 6 of the expansion-bellows 5, the expansion bellows 5, and the lug 7 to a connector or outlet (not shown).

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A microphone assembly comprising:

a microphone; and a holding device attached to said microphone, said holding device including an expansion bellows and an attachment structure, said expansion bellows being secured to said microphone at a first end thereof, said expansion bellows being further secured to said attachment structure on a second end thereof, said expansion bellows constituting a sole interconnection between said microphone and said attachment structure;

wherein said expansion bellows produces a low frequency of resonance and a dissipation capacity between said attachment structure and said microphone.

2. A microphone assembly consisting essentially of:

a microphone;

a lug; and a flexible expansion bellows secured to said microphone on a first end thereof; said flexible expansion bellows being secured to said lug on a second end thereof; said expansion bellows constituting a sole interconnection of said microphone to said lug;

wherein said flexible expansion bellows constitutes a barrier to impact wave transmission between said lug and said microphone resulting in a low frequency of resonance and a dissipation capacity between said attachment structure and said microphone.

3. The microphone assembly of claim 2 wherein said flexible expansion bellows is fabricated of a dimensionally stable material with high acoustic dissipation qualities.

4. The microphone assembly of claim 3 wherein said flexible expansion bellows further includes a case which at least partially encases the microphone.

5. The microphone assembly of claims 4 wherein the lug may be used for adjusting a positioning of the microphone in relation to an object.

6. The microphone assembly of claim 5 wherein said lug is of a swan-necked shape.

7. The microphone assembly of claim 6 wherein the attachment structure is configured for detachable fixation to said object.

8. The microphone assembly of claim 7 wherein the flexible expansion bellows and the lug include a tube for holding at least one signal line and/or supply-line.

* * * * *